US005988786A

United States Patent [19]

Waller et al.

[11] Patent Number: 5,988,786

[45] Date of Patent: Nov. 23, 1999

[54] ARTICULATED STRESS RELIEF OF AN ORIFICE MEMBRANE

[75] Inventors: David J. Waller; Timothy L. Weber, both of Corvallis, Oreg.; Kenneth E. Trueba, Barcelona, Spain; Hai Q. Tran, San Diego, Calif.

[73] Assignee: Hewlett-Packard Company, Palo Alto, Calif.

[21] Appl. No.: 08/885,217

[22] Filed: Jun. 30, 1997

[51] Int. Cl.[6] ..... B41J 2/015

[52] U.S. Cl. ..... 347/20; 347/63

[58] Field of Search ..... 347/44, 47, 20, 347/63

[56] References Cited

U.S. PATENT DOCUMENTS

| | | | |
|---|---|---|---|
| 5,066,357 | 11/1991 | Smyth, Jr. et al. | 156/643 |
| 5,278,584 | 1/1994 | Keefe et al. | 346/140 |
| 5,291,226 | 3/1994 | Schantz et al. | 346/140 |
| 5,305,018 | 4/1994 | Schantz et al. | 346/1.1 |
| 5,312,517 | 5/1994 | Ouki | 156/643 |
| 5,350,616 | 9/1994 | Pan et al. | 428/131 |
| 5,378,137 | 1/1995 | Asakawa et al. | 425/174.4 |
| 5,453,769 | 9/1995 | Schantz et al. | 347/63 |
| 5,467,115 | 11/1995 | Childers | 347/47 |
| 5,847,725 | 12/1998 | Cleland et al. | 347/20 |

*Primary Examiner*—John Barlow
*Assistant Examiner*—Michael S. Brooke
*Attorney, Agent, or Firm*—Raymond A. Jenski

[57] ABSTRACT

An orifice membrane is provided an articulation parallel to the rows of orifices and between the area of the orifice membrane secured to the cartridge body and the area of the orifice membrane secured to the barrier layer of the heater resistor substrate. The reduced stress at the orifices reduces the distortion of the bore axis of the orifices.

17 Claims, 8 Drawing Sheets

– PRIOR ART –

– PRIOR ART –

ARTICULATED STRESS RELIEF OF AN ORIFICE MEMBRANE

The present invention is generally related to a print cartridge for an inkjet printer and more particularly to an articulated orifice membrane for a printhead of an inkjet printer cartridge which improves the trajectory and placement of ink drops by providing reduced deformation of the orifices.

BACKGROUND OF THE INVENTION

Inkjet printing is generally accomplished by expelling droplets of ink from tiny orifices to land on a recording medium such as paper. The most widespread technologies used to expel ink are a thermal process in which ink is vaporized to provide momentum to the ink droplet and a piezoelectric process in which an electromechanical force expels the ink droplet. Although the present invention is applicable to at least these two technologies, the preferred embodiment will be explained using the thermal inkjet process.

A typical inkjet cartridge is shown in FIG. 1, in which the cartridge body member 101 houses a supply of ink and routes the ink to the printhead 103 via ink conduits. Visible at the outer surface of the printhead are a plurality of orifices 105 through which ink is selectively expelled upon commands of the printer (not shown), which commands are communicated to the printhead through electrical connections 107. In one implementation of an inkjet print cartridge, the printhead 103, the orifices 105, and the electrical connections 107 are realized using a technology commonly known as Tape Automated Bonding (TAB). A flexible polymer tape 109, which may be formed of Kapton™, commercially available from 3M Corporation, or similar material which may be photoablated or chemically etched to produce the orifices 105 and other desirable characteristics is formed to have the plurality of orifices extending through the tape. Further copper or other conductive traces are deposited or created on one side of the tape so that electrical interconnections can be made from the printer to a semiconductor substrate. The semiconductor substrate includes thin film resistors for vaporizing the ink and may also contain transistors for multiplexing the electrical signals from the printer to the heater resistors. The semiconductor substrate is typically affixed to the tape by a photo definable adhesive barrier layer which is secured by a process of heat and pressure. Subsequently the tape 109 is typically bent around edges of the print cartridge and secured with an adhesive to the body to provide an uncluttered working surface for the printhead and to enable connection to the printer for the electrical contacts 107.

A close up view of one conventional orifice and firing chamber is illustrated in FIG. 2. The tape 109 is arranged such that the orifice 105, which extends from the inner surface of the tape to the outer surface, is centered essentially over a heater resistor 201 in an ink ejection chamber or ink firing chamber 203. The ink firing chamber is further defined by a photodefinable adhesive, or barrier, layer 205 which is applied to a semiconductor substrate 207. The tape 109 is secured to the other surface 208 of the barrier layer (which surface is generally parallel to the surface of the semiconductor substrate) thereby forming one ink ejecting apparatus of the inkjet printhead. Ink, represented by 209, enters the firing chamber 203 via an opening or edge in the substrate 207 thence across the surface 208 of the substrate to the firing chamber 203. Subsequent to the vaporization process which ejects the ink in a thermal inkjet printhead, the chamber is refilled in replacement of the ink which was expelled.

A cross section of the printhead and the cartridge body is illustrated in FIG. 3. It can be seen that heater resistors 201 and 301 may be arranged on opposite sides of the surface of the substrate 207. Conventionally, heater resistors and associated orifices are arranged in staggered fashion (although the heater resistors may also be arranged colinearly) in two essentially parallel rows on the printhead. Ink droplets 303 are selectively ejected upon command of the printer and the responsive electrical heating of the heater resistors. The tape 109, which includes the plurality of individual orifices and therefore is termed an orifice membrane herein, is adhesively secured to a surface of the body member 101 by adhesive 305 in a fashion which places the top surface (as illustrated in FIG. 3) of the barrier layer 205 parallel to and either elevated above or coplanar with a surface 306 of the body member 101. This adhesive further forms a seal around the substrate so that ink, which is in the ink conduit 307, will not leak from around the junction of the orifice membrane tape 109 and the body member 101. An example of a printhead which may benefit from the present invention is further described in U.S. Pat. No. 5,291,226, assigned to the assignee of the present invention.

It has been observed that ink drops ejected from printheads such as those employing tape orifice membranes may be subject to trajectory errors. U.S. Pat. No. 5,467,115, assigned to the assignee of the present invention, suggested a solution to the problem of such trajectory errors. The orifice membrane, there, is affixed to the barrier layer at the surface of the semiconductor substrate using heat and pressure. The orifice membrane extends beyond the outer edges of the barrier layer substrate (as depicted in FIG. 3 herein), bridges the space between the substrate and the cartridge body member, and is affixed to the body member. During the heating and pressure step used to affix the orifice membrane to the barrier layer, the orifice membrane undesirably bends over the outer edges of the barrier layer, causing the orifices to be uncontrollably deformed or tilted thus resulting in inaccurate trajectory of the ink droplets and less than an optimum quality of printing. As a solution, it was proposed that the orifices be pre-tilted prior to the affixing of the orifice membrane to the substrate barrier layer or that the barrier layer be trenched to provide a compensating deformation of the orifice membrane.

In some instances, the solutions offered are insufficient and further correction is needed, particularly those instances when the surface of the barrier layer of the semiconductor substrate is elevated above the mounting surface of the body member and the orifice membrane is then affixed to the body member. Since the surface of the body member is not coplanar with the surface of the barrier layer on the substrate, the orifice membrane is canted away from being planar, thereby stressing the area near the orifices with a tilting of the orifices as a result. Further, a sloping orifice membrane will reduce the area available for ink flow to the ink firing chamber thereby reducing the speed at which the firing chamber will refill with ink.

SUMMARY OF THE INVENTION

The present invention encompasses an inkjet printer cartridge having improved drop placement accuracy. An ink ejection apparatus is disposed at a first surface of a substrate and forms a second surface essentially parallel to the first surface of the substrate. A body member of the inkjet printer cartridge has a third surface which is spaced apart from the first surface of the substrate and spaced apart by a distance and essentially parallel to the ink ejection apparatus. The body member further provides an ink conduit to the ink ejection apparatus in the spaced apart distance. An orifice membrane is disposed between and secured to the third surface of the body member and the second surface of the ink ejection apparatus. The orifice extends through the orifice membrane from a first side to a second side of the orifice membrane. The orifice membrane further includes an elongate articulation in the first side of the orifice membrane. The articulation is disposed parallel to an edge terminating the first surface of the substrate and extends the first surface of the substrate and the third surface of the body member. Thus, the distance between the second surface and the third surface of the body member may be bridged with reduced distortion of the orifice.

DETAILED DESCRIPTION OF A PREFERRED EMBODIMENT

Figure 1:
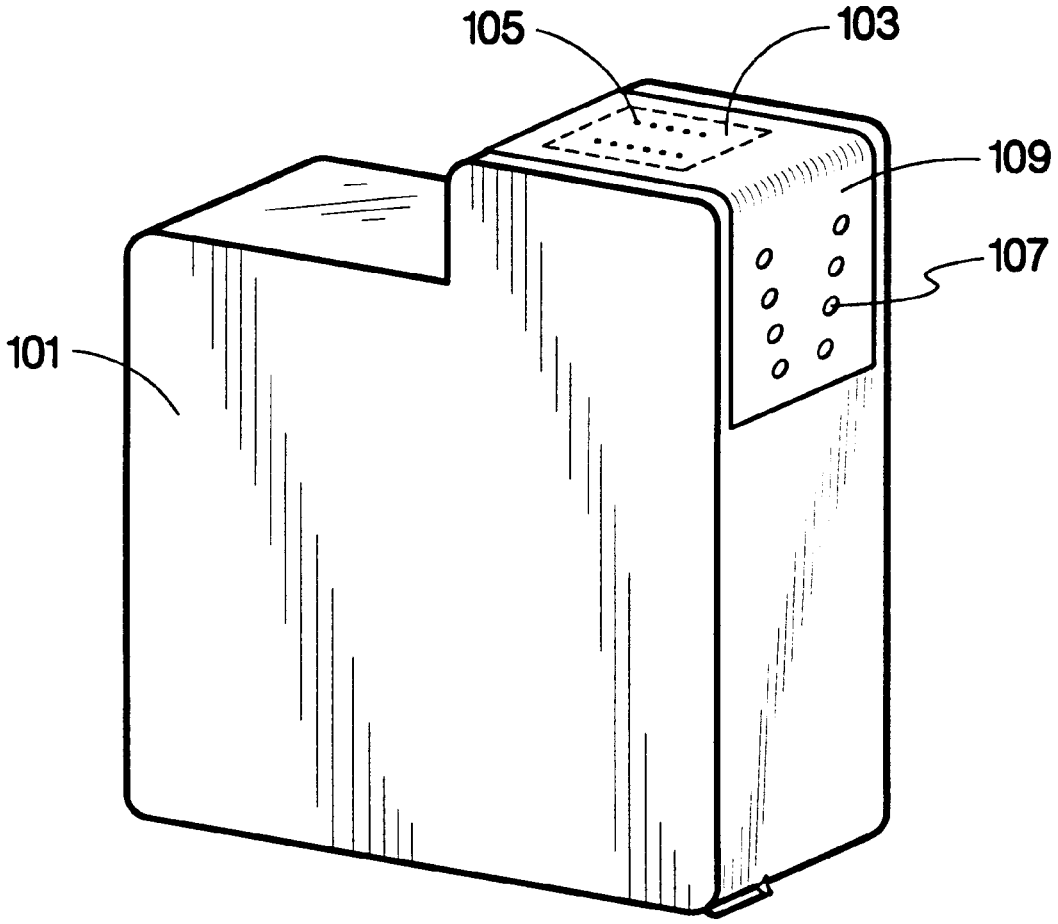
FIG. 1 is an isometric sketch of a conventional inkjet print cartridge.
Figure 2:
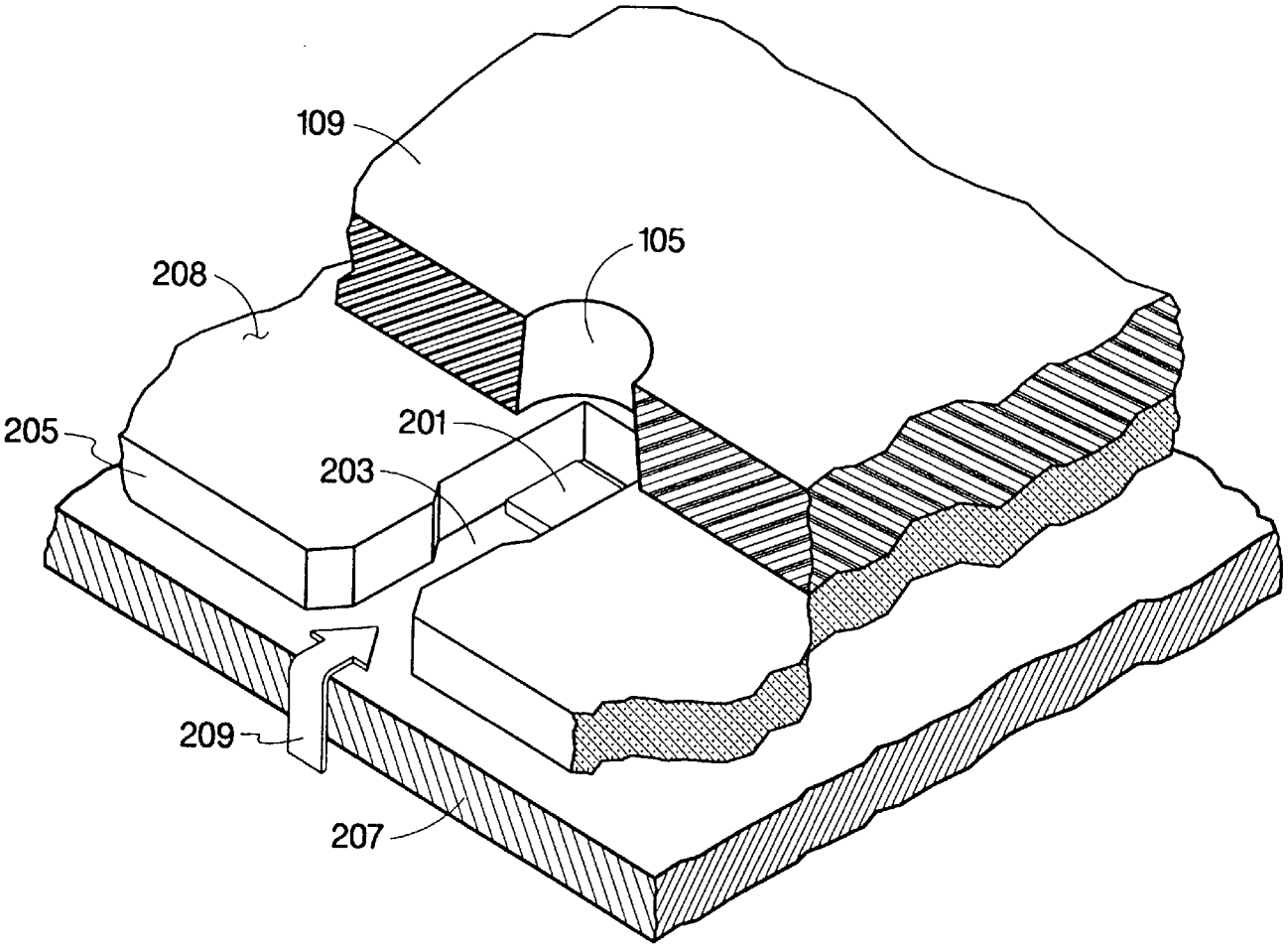
FIG. 2 is a close up sectional view of a firing chamber of an inkjet printhead.
Figure 3:
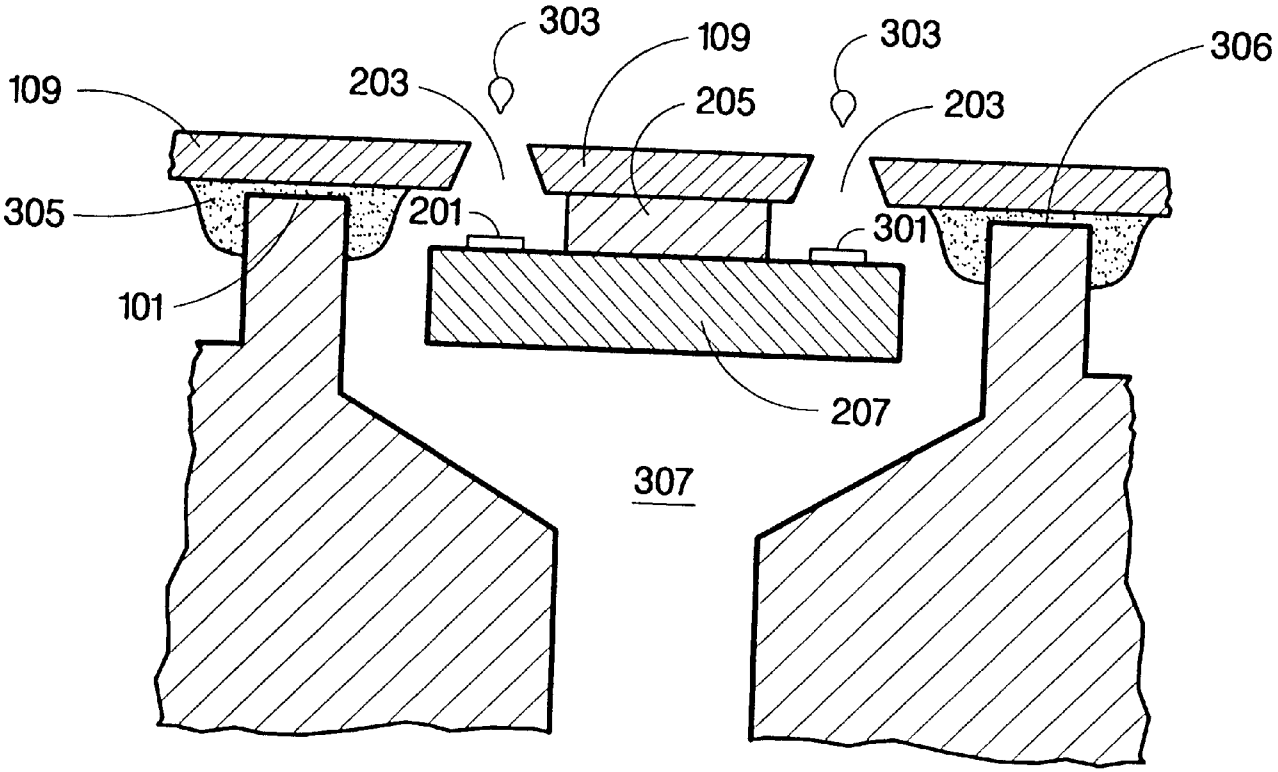
FIG. 3 is a sectional view of an inkjet printhead and print cartridge.
Figure 4A:
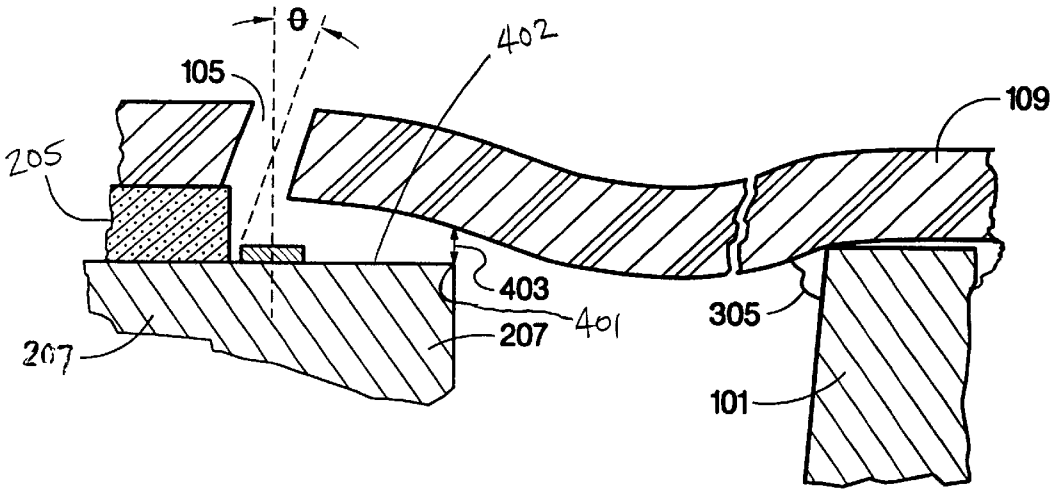
FIG. 4A is a cross section of a printhead illustrating a deflection of the orifice membrane and resultant distortion of the orifice.
Figure 4B:
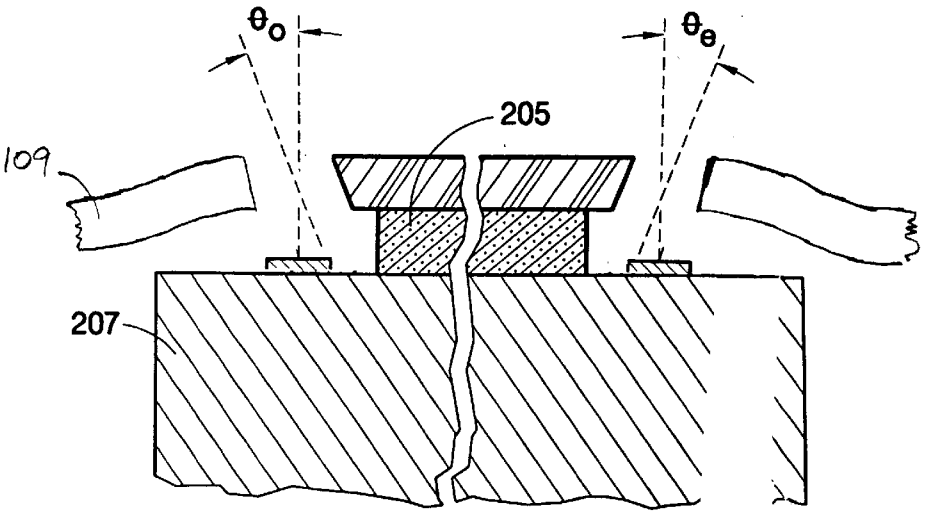
FIG. 4B is a cross section of a printhead, similar to FIG. 4A, illustrating dimple angle gpd NCA in a printhead employing two rows of heater resistors and firing chamers on two edges of the substrate.

Referring now to FIG. 4A, when the flexible tape orifice membrane 109 is secured to the barrier layer 205 of the semiconductor substrate 207, it is often deformed in the area where there is no underlying support from the barrier layer and is particularly troublesome at the edge 401 of the substrate 207 where the ink enters onto the surface 402 (defined by the edge 401) of the substrate and enters the firing chamber. To further exacerbate the deformation problem, the elevation of the upper surface of the barrier layer 205 above the surface of the body member 101 causes the orifice membrane 109 to further bend in a direction toward the surface of the substrate 207. The resulting effect of both the process of orifice membrane 109 adhesion to the barrier layer 205 and the bridging of nonplanar surfaces by the orifice membrane is an orifice having a tilting of the bore axis of the orifice 105 by an angle, θ. In a top-shooting thermal inkjet print cartridge, θ is measured relative to a line normal to the surface of the substrate 207. Since the orifices are usually placed in essentially parallel rows located near opposite edges of the top side of the substrate, the angle of deviation from normal tends to tilt toward the edge of the substrate. This results in orifice bores at one edge of the substrate tilting in one direction and orifice bores at the opposite edge of the substrate tilting in the opposite direction as shown in FIG. 4B. (While FIG. 4B illustrates the preferred embodiment of a printhead in which the ink is supplied to the firing chambers over the edge of the semiconductor which defines the top surface of the semiconductor, the invention need not be so limited. A similar problem of orifice membrane dimpling over ink fill slots cut through the center or elsewhere in the semiconductor substrate is recognized and will realize similar improvements from the present invention).

In both FIG. 4A and FIG. 4B, the surface of the barrier layer 205 is nonplanar and higher than the surface of the body member 101. The orifice membrane is flexed downward toward the edge of the semiconductor substrate 207. If the surface of body member 101 were higher than the surface of the barrier layer 205, of course, the flex of the orifice membrane would be opposite. The angle θ is typically referred to as dimple angle and the total overall difference ($\theta_o$–$\theta_e$) is known as nozzle camber angle (NCA). The ink droplets which are ejected from an orifice having a bore axis distorted with a non-zero dimple angle are deflected away from the normal trajectory and land on the recording medium at a position which is not desirable and is perceived by humans as a reduction in print quality. The deviation from the desired position of printing (one measurement of print quality) is quantified by a measurement known as mean scan-axis placement accuracy (SAD). There is a positive relationship between dimple angle and SAD so an improvement in dimple angle has indicated an improvement in SAD.

Figure 5:
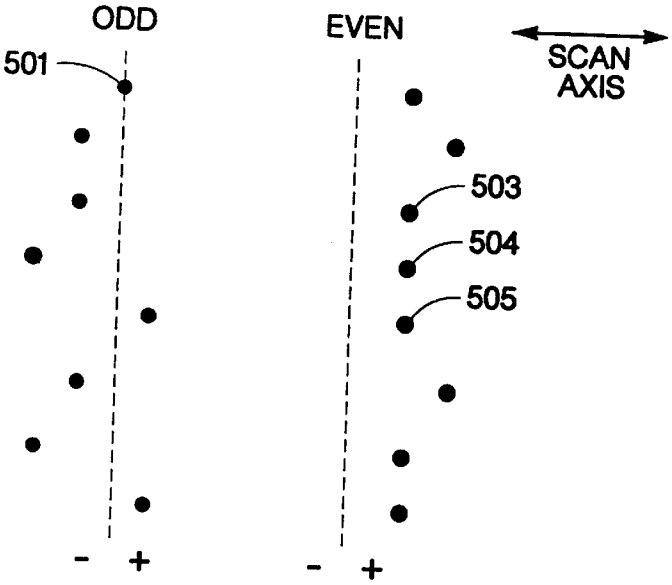
FIG. 5 is a diagram illustrating drop placement error in the scan axis on a printeedium.

Another measurement of significance in objectively determining print quality and drop trajectory error is that of the uniformity of the drop placement. Uniformity of drop placement is quantified as the standard deviation of drop placement about the mean SAD. Referring now to FIG. 5, an example of drop placement accuracy is illustrated as a magnified view of the printed medium showing printed drops expelled from each of two rows of orifices. For convenience they are labeled odd and even. Typically, the two rows of orifices are oriented in an axis perpendicular to the direction an inkjet print cartridge is shuttled across a medium to print a line of text or image (the scan axis), The two rows are also parallel to the direction the medium is advanced to become available for the next line of print. In an ideal situation when so commanded by the printer, the ink drops which are ejected from orifices which are in the same row and are colinear will land on the medium in a vertical line (perpendicular to the scan axis). It should also be noted that in many implementations the ink ejection orifices in each row are placed in a staggered configuration, each adjacent orifice offset a small amount in the direction of the scan axis. The printer process delays the time of ink ejection for selected adjacent orifices so that the ink drop will be placed on the same line as the immediately previously ejected drop. In any event, such a vertical line is exemplified by the broken lines of FIG. 5 which indicate no trajectory error in the scan-axis. Printed drop 501, for example, exemplifies a printed droplet with no scan-axis trajectory error. Thus, a dimple angle of zero for each orifice in a row results in a mean SAD displacement of zero with a zero SAD standard deviation. If the orifices have a consistent non-zero dimple angle, the drops recording on the printed medium would have a positive or negative consistent displacement from the broken line (a non-zero mean SAD but a zero standard deviation from mean SAD) as exemplified by dots 503, 504, 505. Such a uniform error can be compensated for by printer control strategies. Unfortunately, random scan-axis trajectory errors (i.e. a non-zero mean SAD with a non-zero standard deviation from mean SAD) such as exemplified by the odd row orifice printings of FIG. 5, cannot be economically compensated.

Residual stress in the orifice membrane from the attachment to the semiconductor substrate barrier layer and to the body member cause a deflection of the orifice membrane along the length of the substrate. Further stress is generated in the orifice membrane by the ink, which is maintained at a small negative pressure to avoid leakage. These stresses propagate to the vicinity of the orifices where they distort individual orifice exit planes as described heretofore as dimple. In addition to causing drop placement errors as described above, these residual stresses in the orifice membrane regularly cause premature delamination of the orifice member/barrier layer interface. Furthermore, the frequency at which each individual resistor can be energized and ink expelled from the associated orifice is limited by, among other reasons, the rate at which ink will flow into the ink firing chamber to replace the expelled ink.

The problem can best be apprehended from the illustration in FIG. 4A, in which the orifice membrane 109 is caused to bend away from planarity to bridge the gap between the surface of the barrier layer 205 and the surface of the body member 101. The frequency of operation of the printhead is adversely affected by the bent orifice membrane, as a substrate-sloping orifice membrane reduces the cross sectional area through which ink may flow over the edge of the substrate to the ink firing chamber formed by the barrier layer. This pinched area of ink flow is identified by reference numeral 403. Pinching off of the ink flow over the edge of the substrate in this manner increases the time required refill the firing chamber and reduces the speed of operation.

Figure 6A:
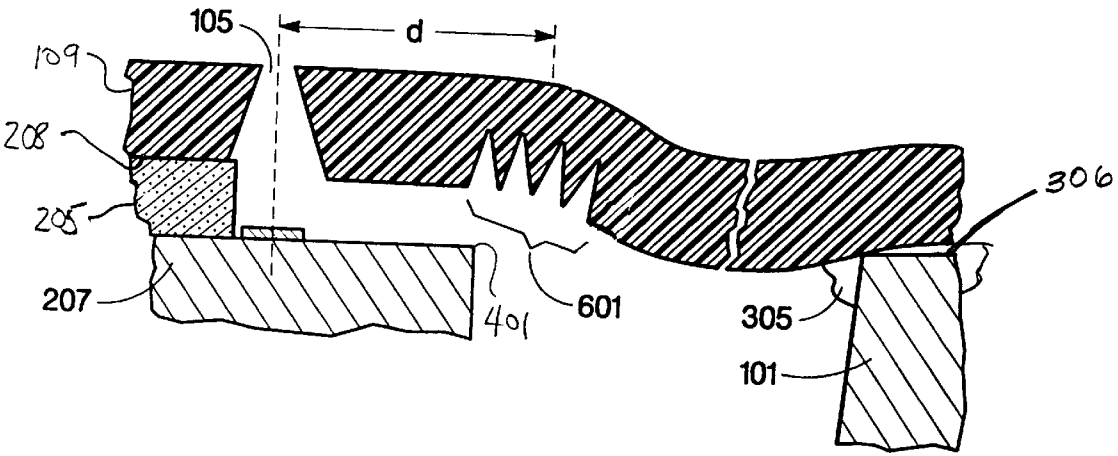
FIG. 6A is a cross section of a printhead which may employ the present mnv tion.
Figure 6B:
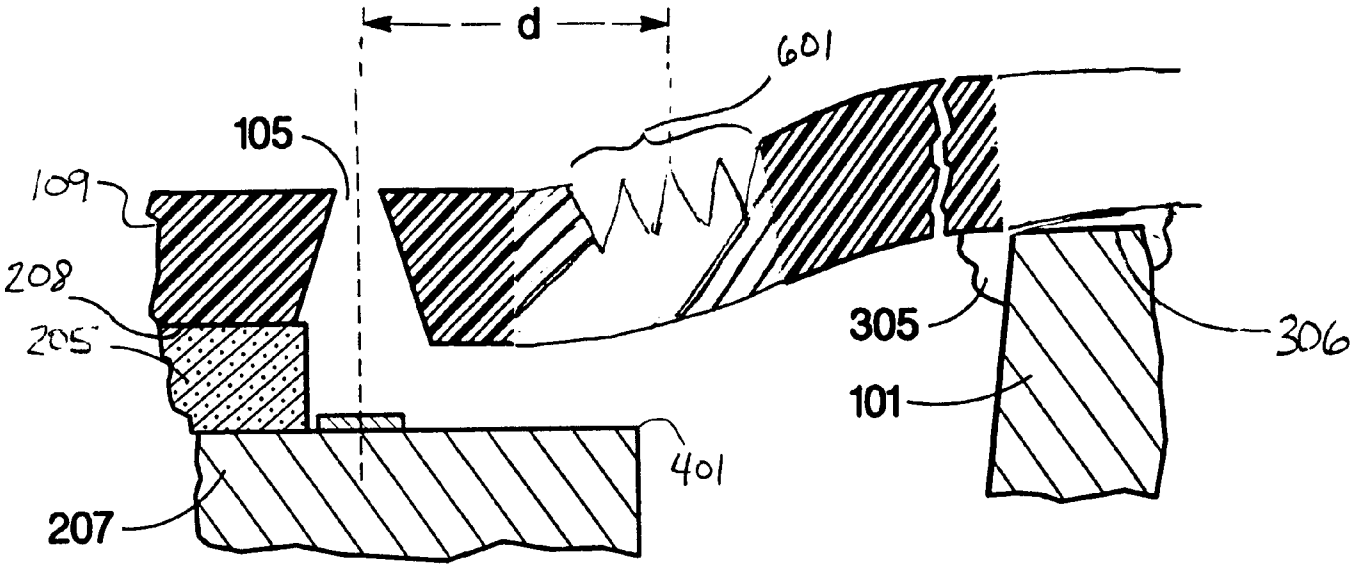
FIG. 6B is a cross section of an alternative embodiment of a printhead which may employ the present invention.

In order to reduce the stress on the orifice membrane, reduce the dimple angle, and maintain a consistent area ink fill channel, an articulation 601 shown in FIG. 6A is introduced into the inner surface of the orifice membrane. This articulation enables stress and strain to be concentrated at a point away from the orifices, i.e. at regions bounded by the ends of the articulations. The reduction of stress at the orifices leads to improved perpendicularity and uniformity of the orifice bore axis with respect to the semiconductor substrate and firing resistor. An alternate embodiment of the present invention, shown in FIG. 6B, is employed to reduce the stress created when the barrier layer surface 208 is manufactured to be below the surface 306 of the body member 101. In this alternative embodiment, the articulation 601 is introduced into the outer surface of the orifice membrane from the barrier layer 205 is achieved while reducing the value and variation of dimple angle of the orifice.

Figure 7:
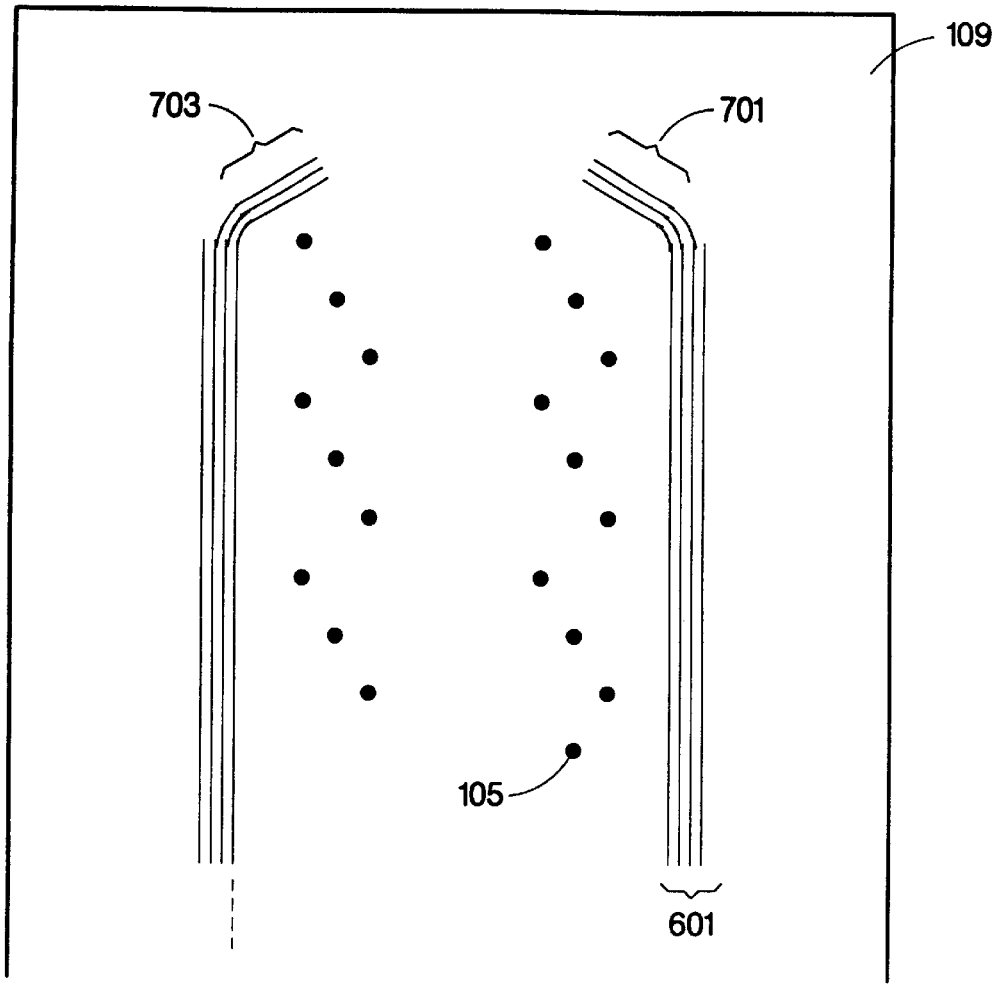
FIG. 7 is a plan view of the orifice membrane surface viewed from the inside (i.e. firing chamber) direction.
Figure 8:
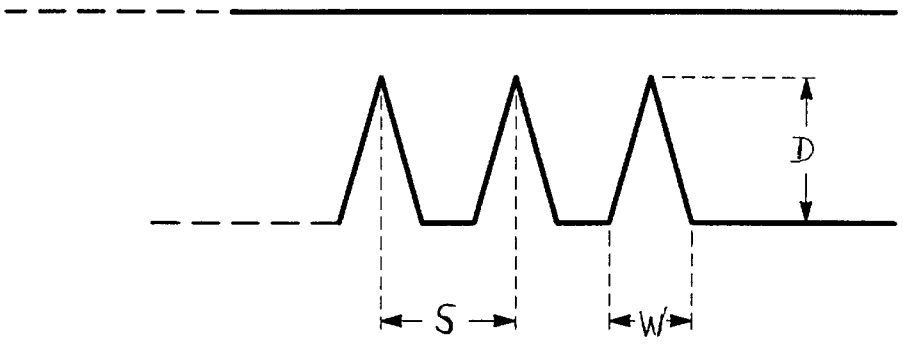
FIG. 8 is a cross section of the orifice membrane which illustrates an articulation which may be employed in the present invention.

FIG. 7 is a plan view of the orifice membrane surface as seen from the inside (i.e. firing chamber) direction which illustrates the articulations 601. These articulations 601 are oriented in a direction parallel to the edge of the substrate and parallel to the long axis of the orifice membrane. In the preferred embodiment the articulations 601 are disposed the entire length of the orifice rows and parallel to each row. To further reduce stress and strain at the end of orifice rows, one embodiment of the invention utilizes articulation extensions 701 and 703 at the orifice row ends.

In the preferred embodiment, the articulation 601 is realized in the form of serrations on the inside of the orifice membrane, such as those shown in the cross section of the orifice in which the center line of the serrations are spaced a distance (d) from the center line bore axis of the most distant orifice of the closest row of orifices. Distance d is calculated to place the center line of the serrations beyond the edge 401 of the substrate 207 while allowing at least one serration to be disposed over the substrate edge 401. In the preferred embodiment, d is equal to approximately 100 micrometers. The serrations are laser ablated grooves disposed in two mil (0.05 mm) Kapton™ tape, created using 250 pulses (no dithering) of a Tamarack 520 excimer laser at 248 nm wavelength and 450 mJ of energy. Several combinations of groove width (W), groove depth (D), groove spacing (S), and number of grooves (N) were created and tested to determine the optimum articulation parameters when used with a Model HP 51645A inkjet print cartridge commercially available from Hewlett-Packard Company, the preferred embodiment of the present invention employs a groove width, W, equal to 10 micrometers; a groove depth, D, equal to between 15 and 45 micrometers and preferably 30 micrometers, a groove spacing, S, equal to 40 micrometers; and a number of grooves, N, equal to 4. Use of the articulated orifice membrane in this embodiment yielded an approximate 2:1 improvement in dimple angle and an approximate 20% improvement in SAD.

Figure 9:
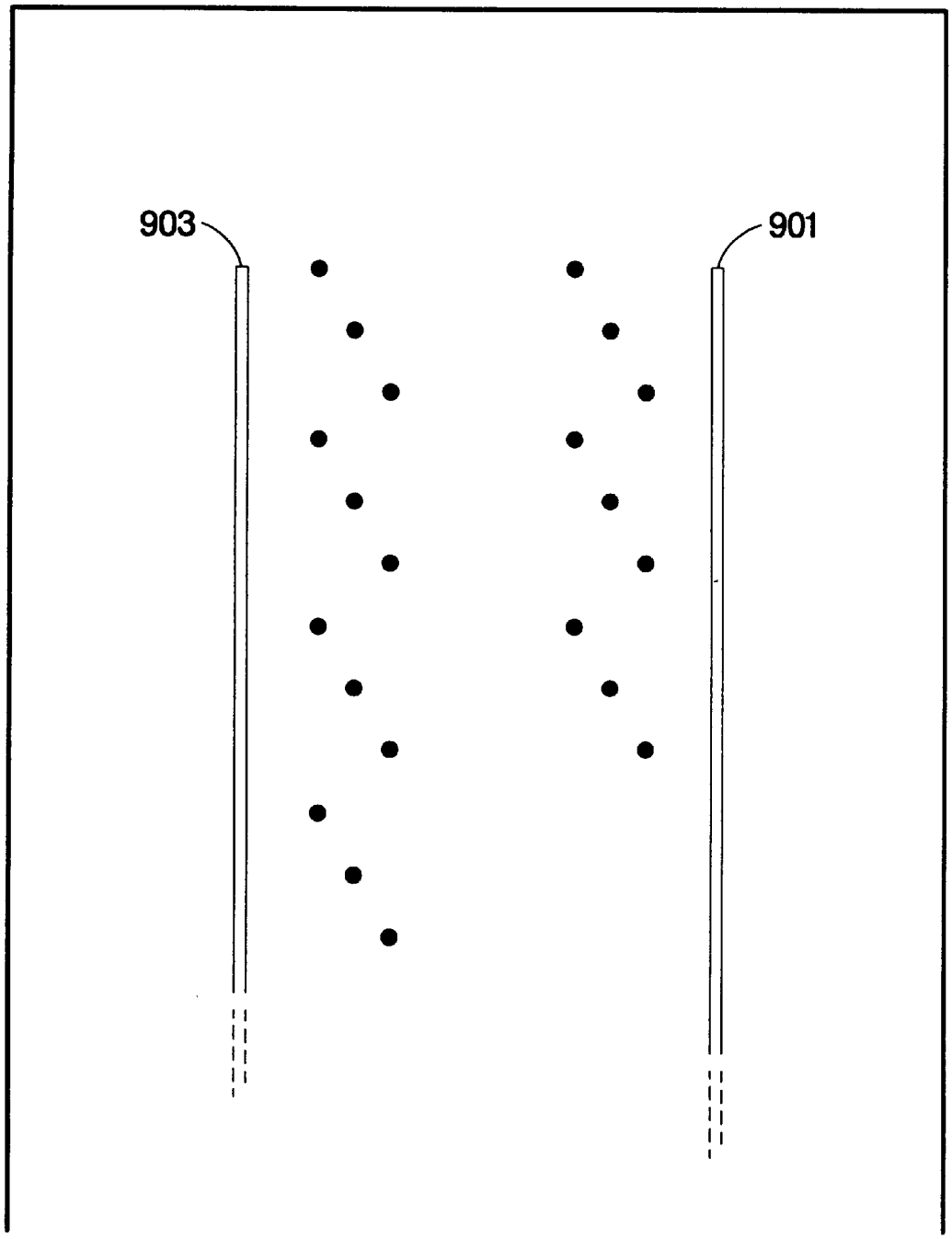
FIG. 9 is an alternative embodiment of the orifice membrane showing in plan view the orifice membrane surface viewed from the inside (i.e. firing chamber) direction.

In an alternative embodiment, as shown in FIG. 9, a slot is ablated completely through the orifice membrane along the length of the substrate and at a distance d equal to approximately 250 micrometers from the center line bore axis of the most distant orifice in the adjacent row of orifices thereby placing the slot beyond the substrate edge 401. The width of the slot in the preferred embodiment is 100 micrometers. While this slot may be created by an excimer laser, the ablation process in the preferred embodiment utilizes a 20W $CO_2$ laser at a wavelength of 10.6 micrometers. Although the slot may be left unsealed, resulting in deformation occurring at the edges of the slot, it is preferred that an ambient-curable adhesive seal the slot and act as a hinge between that part of the orifice membrane attached to the substrate barrier layer and that part of the orifice membrane attached to the body member. This arrangement results in the stress and strain being concentrated at the hinge rather than at the orifices.

In typical operation of an inkjet cartridge employing the present invention, the orifices are oriented such that the orifices are pointing down relative to gravity. In this configuration, particles, coagulants, and other undesirable sediment in the ink tends to concentrate at the lowest point in the inkj et cartridge. It is a feature of the present invention that the articulation in the orifice membrane traps small particles and sediment in the ink before the ink reaches the firing chamber. This additional filtering improves the reliability of the printhead by eliminating smaller particles which otherwise could lodge in the firing chamber or orifice and prevent expulsion of ink.

Thus, an inkjet print cartridge which employs an articulation in the orifice membrane reduces stress in the area near the orifices. Such stress reduction enables the bore axis of the orifices to be more uniformly perpendicular to the plane of the semiconductor substrate and firing resistor. This improvement in dimple angle has been shown to result in improved scan axis displacement accuracy and better quality of print.

We claim:

1. An inkjet printer cartridge having improved drop placement accuracy, comprising:

a substrate having a surface terminated by an edge;

an ink ejection chamber defining layer disposed at said substrate surface to at least partially define an ink ejection chamber for ejecting an ink drop, said ink ejection chamber defining layer further forming a surface essentially parallel to said substrate surface;

a body member having a surface spaced apart from said substrate surface and spaced apart by a distance and essentially parallel to said ink ejection chamber defining layer surface, said body member providing an ink conduit to said ink ejection chamber in said spaced apart distance; and an orifice membrane disposed between and secured to said body member surface and said ink ejection chamber defining layer surface, said orifice membrane having an orifice associated with said ink ejection chamber and extending through said orifice membrane from a first side to a second side thereof, said orifice membrane including a stress relief element in said first side of said orifice membrane, said stress relief element disposed between said surface of said substrate and said surface of said body member, whereby said distance between said ink ejection chamber defining layer surface and said body member surface is bridged with reduced distortion of said orifice.

2. An inkjet printer in accordance with claim 1 wherein said stress relief element further comprises a plurality of serrations disposed in said first side.

3. An inkjet printer in accordance with claim 2 wherein said serrations include 4 grooves disposed in said first side, between 15 and 45 micrometers deep, 10 micrometers wide, and spaced apart by 40 micrometers distance.

4. An inkjet printer in accordance with claim 1 wherein said stress relief element in said first side further comprises a slot, 100 micrometers wide and extending from said first side to said second side of said orifice membrane.

5. An inkjet printer in accordance with claim 2 wherein said first side is affixed to said ink ejection chamber defini layer surface.

6. An inkjet printer in accordance with claim 2 wherein said second side is affixed to said ink ejection chamber defaming layer surface.

7. An inkjet printer in accordance with claim 1 wherein said edge is essentially straight and disposed between said ink ejection chamber and said body member and wherein said stress relief element is essentially linear and further disposed parallel to said edge.

8. A foraminous membrane for a printhead of an inkjet printer cartridge, the printhead having at least one ink ejection chamber formed by a substrate, a barrier layer disposed on a surface of the substrate, and the foraminous membrane disposed at least on a surface of the barrier layer, ink being introduced into the at least one ink ejection chamber from an ink conduit formed by a gap in the barrier layer and between the surface of the substrate and a portion of the foraminous membrane, the foraminous membrane comprising:

a plurality of orifices disposed essentially in a row, said orifices extending from a first side of the foraminous membrane disposed at least in part in contact with the barrier layer to a second side of the foraminous membrane, one of said plurality of orifices associated with the at least one ink ejection chamber; and a stress relief element disposed on said first side of the foraminous membrane, parallel to said row of said plurality of orifices, and at least partially in the portion of the foraminous membrane in the ink conduit.

9. A foraminous membrane in accordance with claim 8 wherein said stress relief element further comprises a plurality of serrations.

10. A foraminous membrane in accordance with claim 9 wherein said plurality of serrations includes 4 grooves disposed in said first side of the foraminous membrane, between 15 and 45 micrometers deep, 10 micrometers wide, and spaced apart by a distance of 40 micrometers.

11. A foraminous membrane in accordance with claim 8 wherein said stress relief element further comprises a slot.

12. A foraminous membrane in accordance with claim 11 wherein said slot further comprises the slot being 100 micrometers wide and extending from said first side to said second side of the foraminous membrane.

13. A method of producing a foraminous membrane for a printhead of an inkjet printer, the printhead having at least one ink ejection chamber formed by a substrate, a barrier layer disposed on a surface of the substrate, and the foraminous membrane disposed at least on a surface of the barrier layer, ink being introduced into the at least one ink ejection chamber from an ink conduit formed by a gap in the barrier layer and between the surface of the substrate and a portion of the foraminous membrane, comprising the steps of:

disposing a plurality of orifices essentially in a row in said foraminous membrane, said orifices extending from a first side of the foraminous membrane disposed on the surface of the barrier layer to a second side of the foraminous membrane, one of said plurality of orifices associated with the at least one ink ejection chamber; and creating a stress relief element disposed on said first side of the foraminous membrane, parallel to said row of said plurality of orifices, and at least partially in the portion of the foraminous membrane in the ink conduit.

14. A method in accordance with the method of claim 13 wherein said step of creating a stress relief element further comprises the step of ablating a plurality of serrations.

15. A method in accordance with the method of claim 14 wherein said step of ablating a plurality of serrations further comprises the step of ablating 4 grooves in said first side of the foraminous membrane, between 15 and 45 micrometers deep, 10 micrometers wide, and spaced apart by a distance of 40 micrometers.

16. A method in accordance with the method of claim 13 wherein said step of creating a stress relief element further comprises the step of introducing a slot in the foraminous membrane.

17. A method in accordance with the method of claim 16 wherein said step of introducing a slot in the foraminous membrane further comprises the step of ablating said slot 100 micrometers wide and extending from said first side to said second side of the foraminous membrane.

* * * * *

UNITED STATES PATENT AND TRADEMARK OFFICE

CERTIFICATE OF CORRECTION

PATENT NO. : 5,988,786
DATED : November 23, 1999
INVENTOR(S) : David J. Waller et al.

It is certified that error appears in the above-identified patent and that said Letters Patent is hereby corrected as shown below:

Column 3,
Line 31, replace the word “gpd” with the word -- and --.
Line 37, replace the word “mnv tion” with the word -- invention --.

Column 6,
Line 53, replace the word “inkj et” with the word -- inkjet --.

Column 8,
Line 44, replace the word “defaming” with the word -- defining --.

Signed and Sealed this

Twenty-seventh Day of August, 2002

*Attest:*

*Attesting Officer*

JAMES E. ROGAN
*Director of the United States Patent and Trademark Office*